US006805758B2

(12) United States Patent
Wolter

(10) Patent No.: US 6,805,758 B2
(45) Date of Patent: Oct. 19, 2004

(54) YTTRIUM MODIFIED AMORPHOUS ALLOY

(75) Inventor: George W. Wolter, Whitehall, MI (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 10/154,453

(22) Filed: May 22, 2002

(65) Prior Publication Data

US 2003/0217790 A1 Nov. 27, 2003

(51) Int. Cl.[7] ..... C22C 45/10
(52) U.S. Cl. ..... 148/403; 420/423
(58) Field of Search ..... 148/403, 561; 420/422, 423; 164/113

(56) References Cited

U.S. PATENT DOCUMENTS

| | | | | |
|---|---|---|---|---|
| 3,989,517 A | | 11/1976 | Tanner et al. | 75/175.5 |
| 4,050,931 A | | 9/1977 | Tanner et al. | 75/175.5 |
| 4,126,449 A | | 11/1978 | Tanner et al. | 75/164 |
| 4,148,669 A | | 4/1979 | Tanner et al. | 148/3 |
| 4,171,992 A | | 10/1979 | Tanner et al. | 148/3 |
| 4,440,585 A | | 4/1984 | Kanehira | 148/403 |
| 4,668,310 A | | 5/1987 | Kudo et al. | 148/304 |
| 5,032,196 A | | 7/1991 | Masumoto et al. | 148/403 |
| 5,288,344 A | | 2/1994 | Peker et al. | 148/403 |
| 5,368,659 A | | 11/1994 | Peker et al. | 148/403 |
| 5,618,359 A | | 4/1997 | Lin et al. | 148/561 |
| 5,711,363 A | * | 1/1998 | Scruggs et al. | 164/113 |
| 5,735,975 A | | 4/1998 | Lin et al. | 148/403 |
| 5,772,803 A | | 6/1998 | Peker et al. | 148/561 |
| 5,797,443 A | * | 8/1998 | Lin et al. | 164/4.1 |
| 5,803,996 A | | 9/1998 | Inoue et al. | 148/672 |
| 5,866,254 A | | 2/1999 | Peker et al. | 428/378 |
| 5,980,652 A | | 11/1999 | Inoue et al. | 148/403 |
| 6,010,580 A | | 1/2000 | Dandliker et al. | 148/403 |
| 6,070,643 A | | 6/2000 | Colvin | 164/61 |
| 6,231,697 B1 | | 5/2001 | Inoue et al. | 148/561 |
| 6,592,689 B2 | * | 7/2003 | Hays | 148/561 |
| 2003/0075246 A1 | * | 4/2003 | Peker | 148/403 |
| 2003/0079813 A1 | * | 5/2003 | Zhang et al. | 148/561 |

OTHER PUBLICATIONS

Yong Zhang et al., "Formation of Zr–Based Bulk Metallic Glasses from Low Purity of Materials by Yttrium Addition," 2000, pp. 1410–1414, *Material Transactions, JIM.*, vol. 41 No. 11.

* cited by examiner

*Primary Examiner*—George Wyszomierski
(74) *Attorney, Agent, or Firm*—Edward J. Timmer

(57) ABSTRACT

An amorphous alloy having a composition consisting essentially of about 45 to about 65 atomic % Zr and/or Hf, about 4 to about 7.5 atomic % Ti and/or Nb, about 5 to about 15 atomic % Al and/or Zn, and the balance comprising a metal selected from the group consisting of Cu, Co, Ni, up to about 10 atomic % Fe, and Y intentionally present in the alloy composition in an amount not exceeding about 0.5 atomic %, such as about 0.2 to about 0.4 atomic % Y, with an alloy bulk oxygen concentration of at least about 1000 ppm on atomic basis.

3 Claims, 3 Drawing Sheets

0.0 %Y, THICKNESS 0.1"

0.2 %Y, THICKNESS 0.1"

0.2 %Y, THICKNESS 0.2"

0.4 %Y, THICKNESS 0.1"

0.4 %Y, THICKNESS 0.2"

YTTRIUM MODIFIED AMORPHOUS ALLOY

FIELD OF THE INVENTION

The present invention relates to amorphous metallic alloys and their manufacture.

BACKGROUND OF THE INVENTION

Amorphous metallic alloys are known which have essentially no crystalline microstructure when rapidly cooled to a temperature below the alloy glass transition temperature before appreciable grain nucleation and growth occurs. For example, U.S. Pat. No. 5,735,975 discloses amorphous metallic alloys represented by the alloy composition, $(Zr,Hf)_a(Al,Zn)_b(Ti,Nb)_c(Cu_x,Fe_y(Ni,Co)_z)_d$ that can be rapidly solidified to produce an amorphous body. The patent indicates that an appreciable amount of oxygen may dissolve in the metallic glass without significantly shifting the crystallization curve. However, the amorphous metallic alloys described in above U.S. Pat. No. 5,735,975 typically are made from pure, laboratory grade components and have a low bulk oxygen impurity content of less than about 200 ppm by weight (or 800 ppm oxygen on an atomic basis).

SUMMARY OF THE INVENTION

The present invention arose from attempts to make amorphous alloys described in the above U.S. Pat. No. 5,735,975 using commercially available raw materials and conventional vacuum die casting equipment. The inventor discovered that bulk oxygen impurity concentrations achievable in the alloy using commercially available raw materials and conventional vacuum melting/die casting equipment were well above the low bulk oxygen impurity concentration of 200 ppm by weight oxygen (800 ppm oxygen on atomic basis) typically present in the patented alloys. The inventor also discovered that such amorphous alloys having a relatively high bulk oxygen impurity concentration could be conventionally vacuum die cast in a plate specimen configuration up to a plate cross-sectional thickness of only 0.1 inch while retaining a bulk (substantially 100%) amorphous microstructure.

An embodiment of the present invention involves an amorphous alloy of the type set forth in the '975 patent made from commercially available raw materials that can be conventionally cast to a substantially greater thickness while retaining a bulk amorphous microstructure. The invention involves providing an intentional addition of yttrium (Y) in the alloy that exceeds zero yet does not exceed about 0.5 atomic % based on the alloy composition, and preferably is in the range of about 0.2 to about 0.4 atomic % Y based on the alloy composition. The Y addition to such amorphous alloys having a relatively high bulk oxygen impurity concentration after the alloy is melted and cast increases alloy resistance to crystallization such that bulk amorphous products with greater dimensions can be made using commercially available raw materials and conventional casting processes.

In an illustrative embodiment of the invention, a Zr based amorphous alloy is provided having an alloy composition, in atomic %, consisting essentially of about 54 to about 57% Zr, about 2 to about 4% Ti, about 2 to about 4% Nb, about 8 to about 12% Al, about 14 to about 18% Cu, and about 12 to about 15% Ni, and about 0.2 to about 0.4% Y with an alloy bulk oxygen impurity concentration of at least about 1000 ppm on an atomic basis. Such an amorphous alloy can be conventionally vacuum melted and die cast to form a bulk amorphous cast plate having a cross-sectional thickness up to 0.2 inch, which is twice the thickness achievable without Y being present in the alloy, despite having relatively high bulk oxygen concentration after melting and casting.

The above and other advantages of the present invention will become more readily apparent from the following drawings taken in conjunction with the following detailed description.

DESCRIPTION OF THE INVENTION

Figure 1:
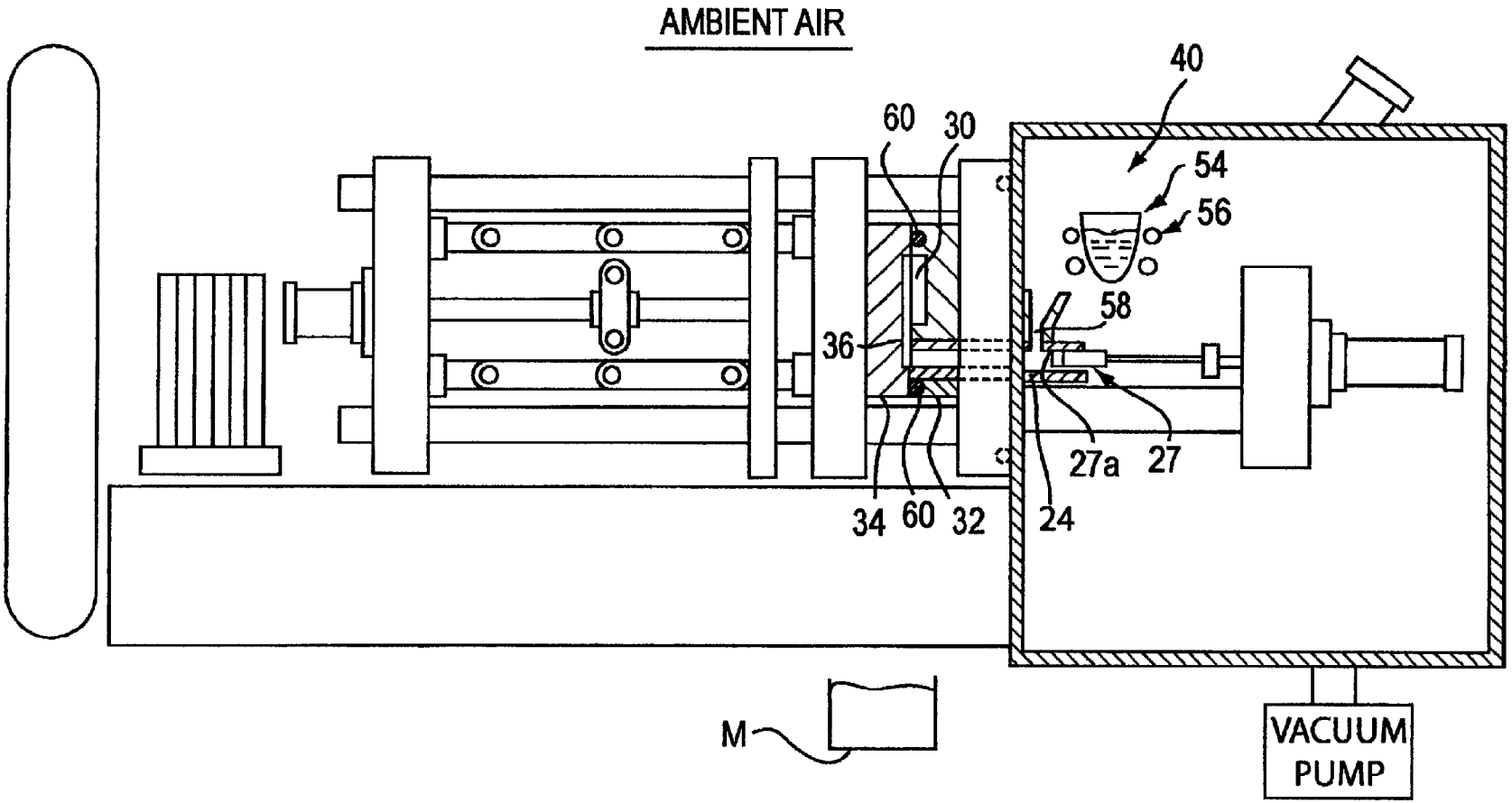
FIG. 1 is schematic view of a vacuum die casting machine used to cast plate test specimens.

The present invention involves modifying an amorphous alloy of the type having a composition consisting essentially of about 45 to about 65 atomic % of at least one of Zr and Hf, about 4 to about 7.5 atomic % of least one of Ti and Nb, and about 5 to about 15 atomic % of at least one of Al and Zn. The balance of the alloy composition comprises Cu, Co, Ni and up to about 10 atomic % Fe and incidental impurities. The ratio of Cu to Ni and/or Co is in the range of from 1:2 to 2:1. Such an amorphous alloy is described in U.S. Pat. No. 5,735,975, the teachings of which are incorporated herein by reference. A preferred alloy composition can be expressed as: $(Zr,Hf)_a(Al,Zn)_b(Ti,Nb)_c(Cu_x,Fe_y(Ni,Co)_z)_d$, where a is greater than 45 and less than 65, b is greater than 5 and less than 15, c is greater than 4 and less than 7.5, d=100−(a+b+c), d multiplied by y is less than 10, and x/z is greater than 0.5 to less than 2 as specified in the '975 patent.

The amorphous alloy is modified pursuant to the present invention by being made using commercially available raw materials that, in combination with subsequent conventional vacuum melting and casting, can result in a relatively high bulk oxygen impurity concentration in the range of about 300 to about 600 ppm by weight (about 1000 to about 2000 ppm oxygen on atomic basis) after the alloy is melted and cast. For purposes of illustration and not limitation, such raw materials typically include the following commercially available alloy charge components which are melted to form the alloy: Zr sponge having 100 to 300 ppm O impurity, Ti sponge having 600 ppm O impurity, Ni shot having 50 ppm O impurity, and a Ni—Nb master alloy having 300 to 500 ppm O impurity (ppm's by weight). The bulk oxygen impurity concentration is the oxygen concentration of the melted and cast alloy resulting from the raw materials that are melted together, from the melting process, and from the casting process to make a cast body or product. For example, in addition to oxygen impurities introduced into the alloy from the raw materials, additional oxygen impurities can be introduced into the alloy from residual oxygen present in the melting chamber and/or in a die or mold cavity in which the molten alloy is cast to form a cast body or product, and/or by reaction of the molten alloy with a ceramic material (metal oxide), such as zirconia, forming a crucible in which the alloy is melted and/or a mold in which the molten alloy is cast.

For purposes of illustration and not limitation, the above charge components can be melted in an induction melting crucible that comprises graphite, zirconia, and/or other suitable refractory material and present in appropriate proportions to yield the desired alloy composition. For purposes of illustration and not limitation, the charge components can be first melted in a graphite or zirconia crucible at a temperature in the range of 2700 to 3000 degrees F. under a gas (e.g. inert gas) partial pressure to reduce aluminum volatilization, cooled to a lower temperature where a vacuum of about 2 to about 20 microns, such as 2 to 5 microns, is established, and then remelted at 1800 to 2100 degrees F. under the vacuum followed by casting. The invention is not limited to any particular melting technique and can be practiced using other melting techniques such as cold wall induction melting (in a water-cooled copper crucible), vacuum arc remelting, electrical resistance melting, and others in one or multiple melting steps.

The amorphous alloy is also modified pursuant to the present invention in that an intentional addition of yttrium (Y) is made to the alloy composition. The Y addition is greater than zero yet does not exceed about 0.5 atomic % based on the alloy composition, and preferably is in the range of about 0.2 to about 0.4 atomic % Y based on the alloy composition. The Y addition typically is made by including with the above commercially available raw material charge components, a Y-bearing charge component comprising a Y-bearing master alloy, such as a commercially available Al—Y master alloy, Ni—Y master alloy or others, and/or elemental Y, although the invention is not limited in the way in which Y can be introduced.

The Y addition to the above amorphous alloy having a relatively high bulk oxygen impurity concentration (about 300 to about 600 ppm by weight) increases alloy resistance to crystallization such that bulk amorphous cast products with greater dimensions can be made by conventional vacuum casting processes. Such conventional casting processes will provide cooling rates of the molten alloy typically of $100^2$ to $100^3$ degrees C. per second and lower. Vacuum die casting is an illustrative conventional casting process for use in practicing the invention as described below, although the invention can be practiced using other conventional casting processes including, but not limited to, vacuum gravity casting, and is not limited in this regard.

Amorphous cast products made pursuant to the invention typically will have at least 50% by volume of the amorphous or glassy phase. This is effectively a microscopic and/or macroscopic mixture of amorphous and crystalline phases in the cast product or body. Preferably, bulk amorphous cast products or bodies made pursuant to the invention typically have between about 80% and about 90% by volume of the amorphous or glassy phase, and even more preferably about 95% by volume or more of the amorphous or glassy phase.

Pursuant to an illustrative embodiment of the present invention, a Zr based amorphous alloy is provided having an alloy composition, in atomic %, consisting essentially of about 54 to about 57% Zr, about 2 to about 4% Ti, about 2 to about 4% Nb, about 8 to about 12% Al, about 14 to about 18% Cu, and about 12 to about 15% Ni, and about 0.2 to about 0.4% Y. Such an alloy has a bulk oxygen impurity concentration that typically is about 300 to about 600 ppm by weight (about 1000 to about 2000 ppm on atomic basis) after melting and/or casting as a result of oxygen impurities being introduced into the alloy from the raw materials, the melting process, and the casting process. Such a Zr based amorphous alloy can be conventionally vacuum die cast to form a bulk amorphous cast plate having a cross-sectional thickness, which typically is at least twice the thickness achievable without Y being present in the alloy composition.

The following example is offered to further illustrate but not limit the invention.

Zr based amorphous test alloys were made having an alloy composition, in atomic %, consisting essentially of 55% Zr, 2% Ti, 3% Nb, 10% Al, 16.5% Cu, 13.5% Ni, with various Y concentrations of 0%, 0.2%, 0.4%, 0.5%, and 2.0% Y. The test alloys were made using the above-described commercially available raw materials. The test alloys had a relatively high bulk oxygen impurity concentration in the range of 300 to 600 ppm by weight (1000 to 2000 ppm on atomic basis) for all alloys tested after die casting.

For the test alloys, the above raw materials were first melted in a graphite crucible 54 in a vacuum melting chamber 40 of a vacuum die casting machine of the type shown schematically in FIG. 1 and described in Colvin U.S. Pat. No. 6,070,643, the teachings of which are incorporated herein by reference. The raw materials were melted at a temperature in the range of 2700 to 3000 degrees F. under an argon partial pressure of 200 torr, then cooled to about 1500 degrees F. where a vacuum of 5 microns was established in chamber 40, and then remelted at 1800 to 2100 degrees F. under the vacuum followed by die casting. Each melted test alloy was poured from crucible 54 through opening 58 into a shot sleeve 24 and then immediately injected by plunger 27 into a die cavity 30. Die cavity 30 was defined between first and second dies 32, 34 and communicated to the shot sleeve via entrance gate or passage 36. A seal 60 was present between dies 32, 34. The dies 32, 34 comprised steel and were disposed in ambient air without any internal die cooling. The die cavity 30 was evacuated to 5 microns through the shot sleeve 27 and was configured to produce rectangular plates (5 inches width by 14 inches length) with a different plate thickness being produced in different casting trials. The plunger speed was in the range of 20–60 feet/second. The plunger tip 27*a* comprised a copper alloy. The alloy casting was held in the die cavity 30 for 10 seconds and then ejected into ambient air and quenched in water in container M.

Figure 2A:
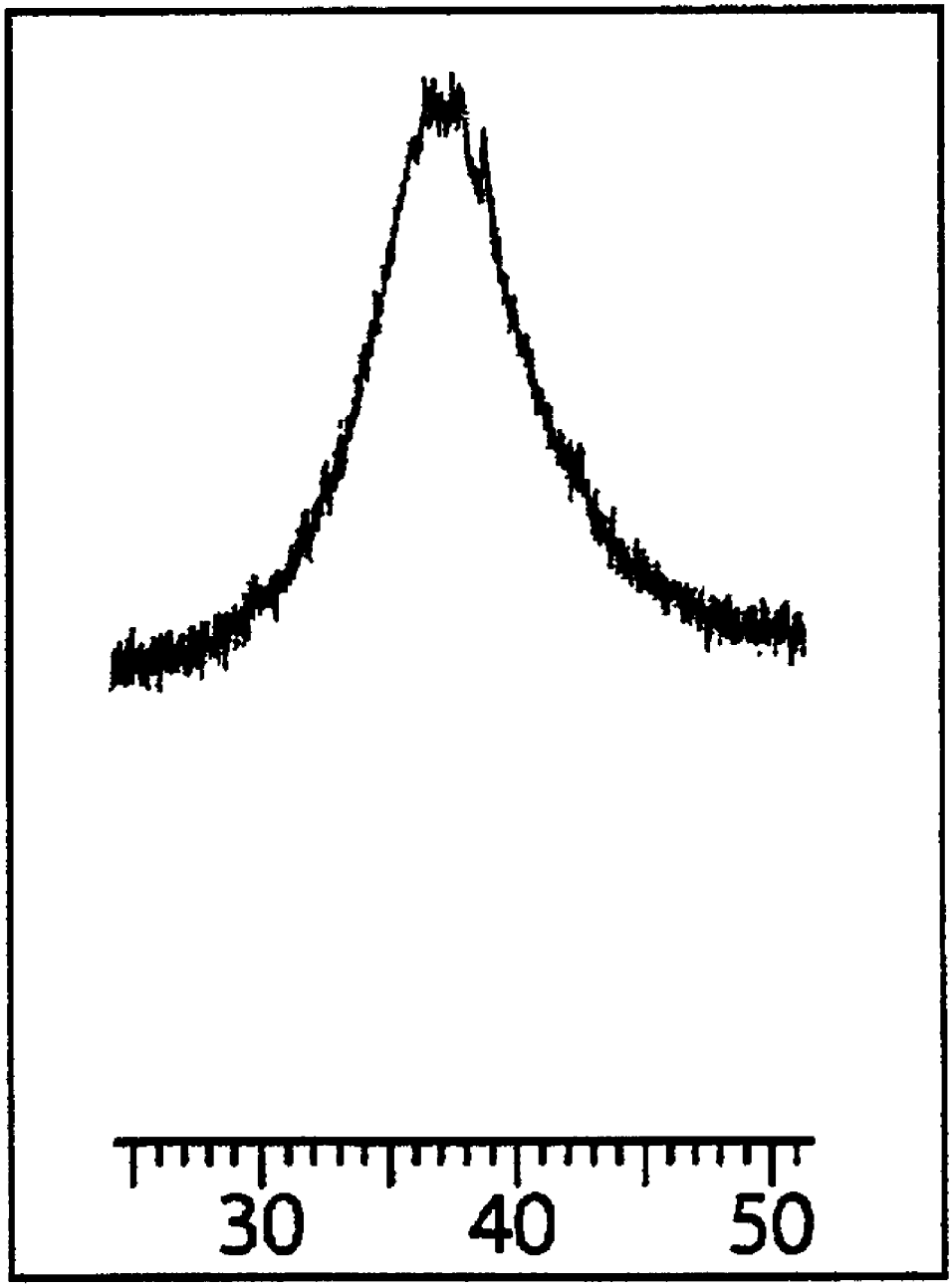
FIGS. 2A, 2B, 2C, 2D and 2E are x-ray diffraction patterns of Zr based amorphous alloys with different Y concentrations and vacuum die cast to different plate thicknesses shown.

The vacuum die casting trials revealed that amorphous plates made of the test alloy devoid of Y (0% Y) could be vacuum die cast with a bulk amorphous microstructure to a plate thickness up to only 0.1 inch. FIG. 2A shows a diffraction pattern for the 0.1 inch bulk amorphous cast plate comprising the test alloy with 0% Y. If the plate thickness was increased above 0.1 inch, then the vacuum die cast plate of the test alloy with 0% Y exhibited a crystalline core within an outer amorphous shell.

Figure 2B:
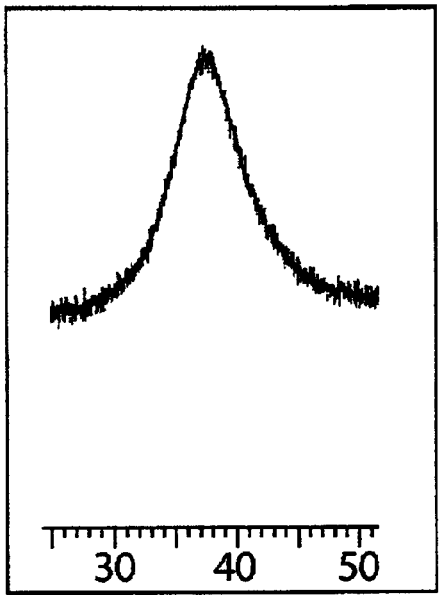
Figure 2C:
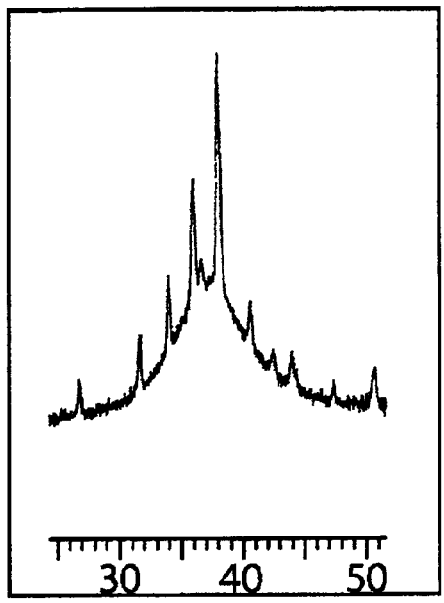

The vacuum die casting trails also revealed that amorphous plates made of the test alloys having 0.2 atomic % Y could be vacuum die cast with a bulk amorphous microstructure to a plate thickness up to 0.1 inch. FIGS. 2B and 2C show respective diffraction patterns for the 0.1 inch and 0.2 inch bulk amorphous cast plates comprising the test alloy with 0.2 atomic % Y. FIG. 2B represents a diffraction typical of a bulk amorphous microstructure at a plate thickness of 0.1 inch. FIG. 2C represents a diffraction indicating a non-bulk amorphous microstructure at a plate thickness of 0.2 inch where a crystalline phase comprising an intermetallic compound was present and indicated by presence of secondary diffraction peaks.

Figure 2D:
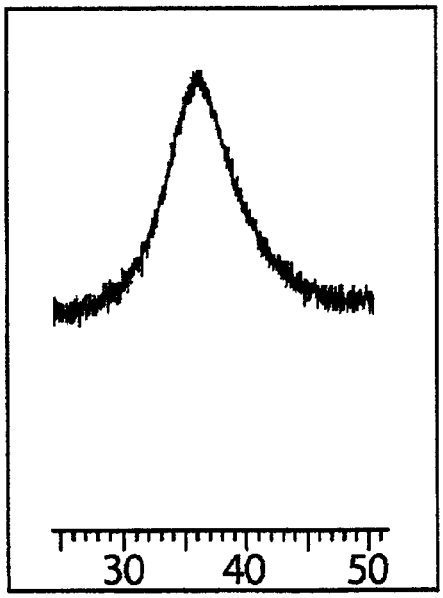
Figure 2E:
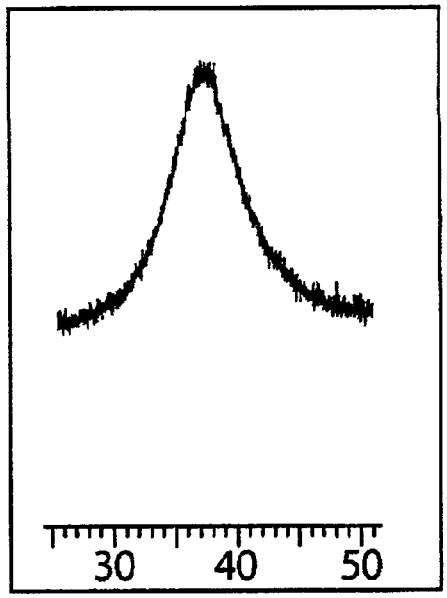

The vacuum die casting trails further revealed that amorphous plates made of the test alloys having 0.4 atomic % Y could be vacuum die cast with a bulk amorphous microstructure to a plate thickness up to 0.2 inch. FIGS. 2D and 2E show respective diffraction patterns for the 0.1 inch and 0.2 inch bulk amorphous plates comprising the test alloy with 0.4 atomic % Y. FIGS. 2D and 2E both represent a diffraction pattern typical of a bulk amorphous microstructure at a plate thickness of 0.1 inch and 0.2 inch. Thus, at a Y concentration of 0.4 atomic % in the test alloy, a bulk amorphous microstructure was obtained at a plate thickness of 0.1 inch and 0.2 inch, which is twice the bulk amorphous thickness achievable without Y being present in the test alloy.

The vacuum die cast plates made of the test alloy having 0.5 atomic % Y and 2.0 atomic % Y produced a deleterious brittle, crystalline second phase in an amorphous cast microstructure at a plate thickness of 0.1 inch and 0.2 inch. These cast plates were brittle and fractured easily.

Although the invention has been described with respect to certain embodiments, those skilled in the art will appreciate that modifications, and the like can be made without departing from the scope of the invention as set forth in the appended claims.

I claim:

1. An alloy consisting essentially of, in atomic %, about 54 to about 57% Zr, about 2 to about 4% Ti, about 2 to about 4% Nb, about 8 to about 12% Al, about 14 to about 18% Cu, and about 12 to about 15% Ni, and about 0.2 to about 0.4% Y with said alloy having a bulk oxygen impurity concentration of least about 1000 ppm on atomic basis.

2. A bulk amorphous cast body having a composition consisting essentially of, in atomic %, about 54 to about 57% Zr, about 2 to about 4% Ti, about 2 to about 4% Nb, about 8 to about 12% Al, about 14 to about 18% Cu, and about 12 to about 15% Ni, and about 0.2 to about 0.4% Y with said cast body having a bulk oxygen impurity concentration of least about 1000 ppm on atomic basis.

3. The cast body of claim 2, which is die cast.

* * * * *